United States Patent [19]

Fons

[11] Patent Number: 4,656,793

[45] Date of Patent: Apr. 14, 1987

[54] EXPLOSION COVER PLATE ESPECIALLY EXPLOSION HATCH

[75] Inventor: Gerrit Fons, HE Zaandam, Netherlands

[73] Assignee: Jansens & Dieperink B.V., HE Zaandam, Netherlands

[21] Appl. No.: 277,249

[22] Filed: Jun. 25, 1981

[30] Foreign Application Priority Data

Apr. 13, 1981 [DE] Fed. Rep. of Germany ..... 3114941

[51] Int. Cl.[4] ..... E04B 1/92

[52] U.S. Cl. ..... 52/98; 52/1

[58] Field of Search ..... 52/1, 232, 98, 99, 100; 114/116, 117, 201 R, 173; 49/141

[56] References Cited

U.S. PATENT DOCUMENTS 3,807,106 4/1974 Reinhardt ..... 52/98
4,207,706 6/1980 Haines ..... 49/141

FOREIGN PATENT DOCUMENTS 62696 10/1981 European Pat. Off. .
1076435 4/1954 France .
2419444 10/1979 France .
1284731 8/1972 United Kingdom ..... 52/1

OTHER PUBLICATIONS

VDI-Richtlinien 3675, Jun. 1979, pp. 5/6.

*Primary Examiner*—Alfred C. Perham
*Attorney, Agent, or Firm*—Wallenstein, Wagner, Hattis, Strampel & Aubel

[57] ABSTRACT

In order to enable accurate regulation of the automatic opening of explosion cover plates at predetermined differences in pressure the cover plate is not only retained in a rubber-elastic sealing clamping section but additionally is supported by at least one counter-support, e.g. as shown in FIG. 2, constituted by a lever arm which will be swung from its supporting position when the limit load is exceeded.

8 Claims, 6 Drawing Figures

EXPLOSION COVER PLATE ESPECIALLY EXPLOSION HATCH

The present invention/innovation relates to an explosion cover plate, especially an explosion hatch, of the type specified in the preamble of claim 1.

Such explosion cover plates have already been known (VDI-Richtlinien 3673 relating to the release of pressure in dust explosions, June 1979, pp. 5/6). The disk-like cover plate is retained within a rubber clamping section. When an unacceptable overpressure is reached in any container or tank closed by the cover plate the disk will be urged, especially explosively, from the clamping section. In this connection it has also been known to retain such disks similar to explosion doors in order to prevent their being flung away.

Such explosion cover plates may be employed especially in plants where dust explosions have to be expected. Their valve-action is intended to prevent breakage of, or damage to, parts of the plant at undesired locations caused by a certain overpressure. The explosion cover plates constitute the "weakest" parts of the plant or the container or the wall, respectively, so that the over-pressure may be balanced. Accordingly, such explosion cover plates may also be employed in systems where undesirable negative pressures may occur.

It has, however, been found that the pressure at which the "release" is to take place is difficult to adjust, especially when the size of the plate is about 1 $m^2$ or more.

It is therefore the object of the present invention/innovation to improve the explosion cover plate of the species mentioned above such that, while the plate is of simple construction its adjustability with respect to response and to the predetermined overpressure or negative pressure, respectively, may be improved.

The invention/innovation resides in that the clamping section is bridged by at least one lever arm one side of which is pivoted to the wall—or to the plate—and the other side thereof is supported by the plate or, respectively, the wall or, respectively, the clamping section when a locking element which in the closure position prevents rotation of the lever arm about the pivot permits rotation of the lever arm about the pivot by breaking upon the occurrence of the predetermined overpressure or, respectively, negative pressure.

In the invention/innovation, the holding pressure which retains the plate within the opening in the wall is no longer transmitted only by the sealing member formed as a clamping section and consisting especially of rubber or of a rubber-elastic plastics material. Rather, the lever arm has the function of additionally supporting the plate. In order to enable good adjustment of this supporting force it is recommended in accordance with a special embodiment of the invention/innovation to equip the lever arm on the side remote from the pivot with an adjusting element, particularly with a screw, whose tip or head may be brought into engagement with the outer side of the plate. By adjusting the screw it is also possible to vary the pressure transmitted from the lever arm to the plate, because the clamping section of the sealing member is flexible on account of its flexural properties and the plate may be somewhat deflected from the normal holding position.

If, however, the pressure difference between the outer and the inner side of the plate or, respectively, the space closed by the plate becomes excessive, this force can no longer be absorbed by the lever arm or by the locking element, respectively; the latter will then fail to be effective as a locking element and will permit the lever to turn about the pivot. Thereby the plate is enabled to yield towards the lever arm and to be released from the clamping section or, respectively, to urge the clamping section out of its seating within the wall, whereby the balancing of pressures is effected.

By suitable selection of the design and the material of the locking element, which preferably is a shearing pin, as well as by suitable selection of the distance of the locking element from the pivot it is possible to correspondingly adjust the "explosive force" required to render the locking element inoperative. In order to provide an adjustability also in this respect it is recommended to make the distance from the locking element to the pivot variable.

Further embodiments of the invention/innovation are claimed in the subclaims and will be explained below with reference to the accompanying drawing, in which:

Figure 1:
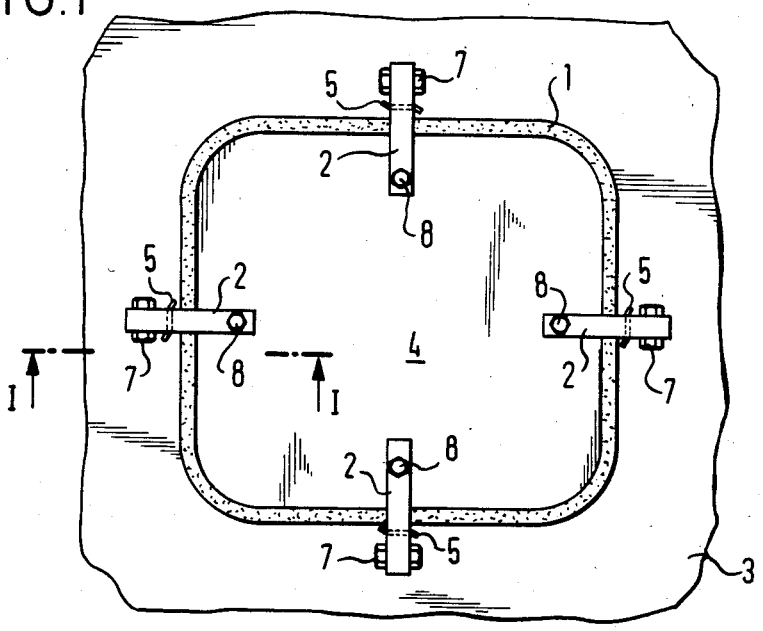
FIG. 1 is a schematic partial plan view of a hold closed by an explosion hatch.

As shown in FIG. 1, on a wall 3 such as the deck of a ship covering the top of a hold there is provided a loading hatch with an opening of several square meters, which is closed by means of a plate 4 constituting the explosion cover plate according to the invention/innovation, which plate may also be called a "hatch cover". The outer edge of the plate 4 is inserted into a recess of a clamping section 1 the opposite recess of which—as will be apparent especially from FIG. 2—is mounted on the rim 9 of the wall 3 defining the opening. In this closure position the clamping section 1 forms a sealing member preventing rain or seawater from penetrating into the hold cover by the plate 4. Moreover the clamping section 1 retains the plate 4 in the desired position.

Figure 2:
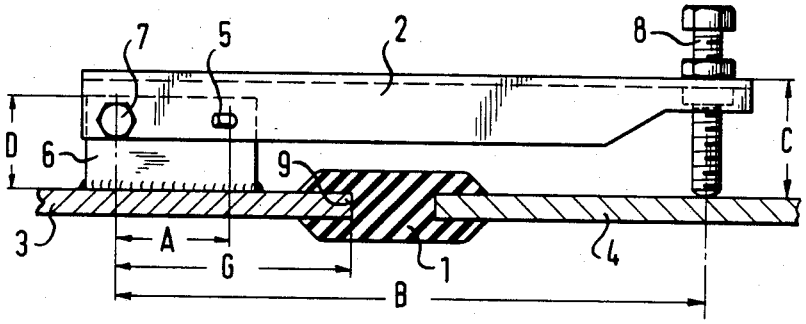
FIG. 2 is a side view, partially in cross-section, along the line I—I of FIG. 1.
Figure 3:
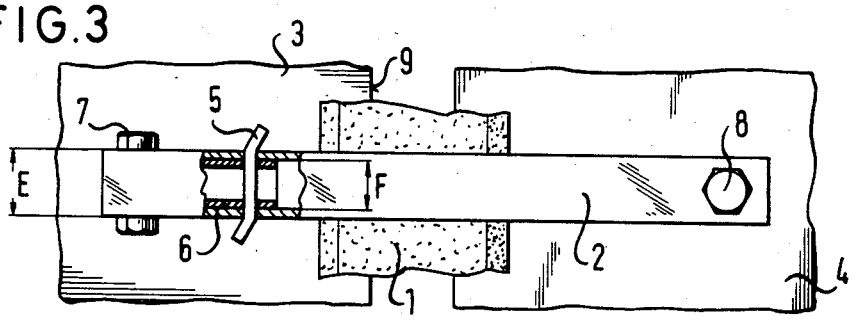
FIG. 3 is a top view—partially broken away—of the area of the lever arm and the corresponding transitional zone from the wall via the clamping section to the plate.

In addition to this mounting system for the plate 4, which has been known, the plate is also supported by means of a lever arm 2 the left end of which—in FIG. 2—is pivotally secured at the pivot 7 by means of a pin to a U-section bearing block 6 whose web portion is welded to the wall 3. The opposite end of the lever arm 2 is provided with an adjusting element 8 which is constituted by a screw and the free end of which may be brought to bear against the outer side of the plate 4. The distance C between the upper edge of the lever arm 2 and the outer side of the plate 4 may be varied by turning the screw, i.e., the adjusting element 8. In order to permit in case of such a variation of the distance C also the transmission of forces via the lever arm 2 to the plate 4 the lever arm 2 is additionally connected to the bearing block 6 at a distance A from the pivot 7 by means of a shearing pin serving as a locking element 5.

The distance A is e.g. 70 mm while the distance B from the point of engagement of the adjusting element 8 with the plate 4 to the pivot 7 is about 30 cm. The adjusting element 8 may e.g. be a screw provided with a thread M12, while the shearing pin is of aluminum and has a diameter of 6 mm. The bearing block 6 is a U-iron having a thickness of 4 mm and the dimensions 40×50×40 mm. The lever arm 2 also is a U-iron but has the dimensions 40×60×40 mm so that there will be no play on either side between the inner sides of the legs of the lever arm 2 and the outer sides of the legs of the bearing block 6. Therefore the height D of the legs of the bearing block 6 is 40 mm. The distance G from the pivot 7 to the rim 9 of the wall 3 defining the opening is about 12 cm in this embodiment. The lever arm 2 has a width of 60 mm, and the bearing block 6 has a width F of 50 mm.

When the pressure in the interior, i.e., beneath the plate 4, becomes unacceptably high, such a large force will be transmitted from the plate 4 via the adjusting element 8 and the lever arm 2 and from the locking element 5 to the bearing block 6 and the wall 3 that when a limit value is reached or exceeded the shearing pin or, respectively, the locking element 5 will break and the lever arm 2 will be released from its locking position and may swing about the pivot 7. Thereby the lever arm 2 is prevented from transmitting any more force to the plate 4 so that the latter will be torn out of the clamping section 1 or, respectively, the clamping section 1 will be torn out of the wall 3. Thereby the "valve action" of the explosion cover plate is ensured.

Figure 4:
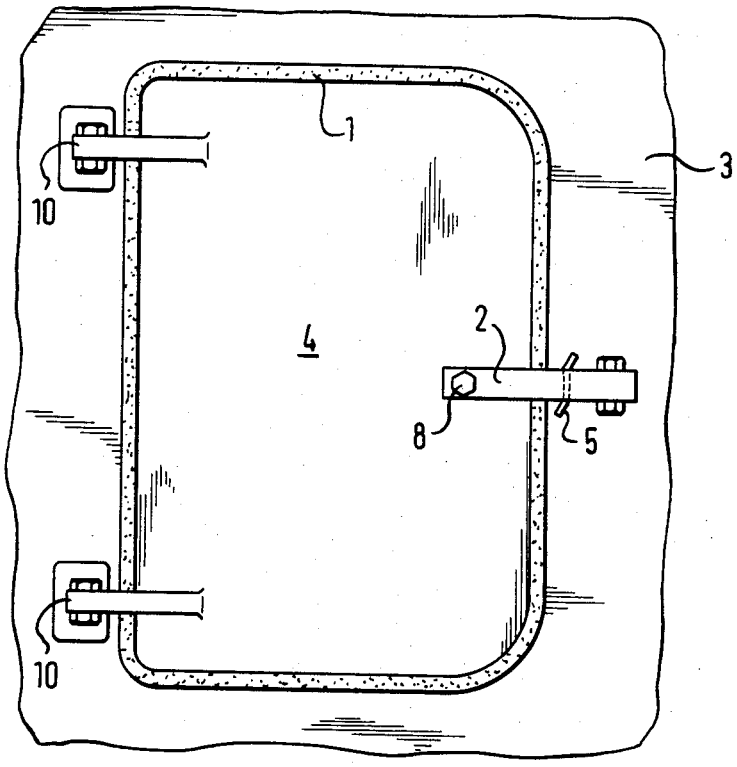
FIG. 4 is another embodiment of the invention/innovation according to FIG. 1 and shows a fragmentary portion of the plan view of an explosion door.

In the embodiment of the invention/innovation according to FIG. 4 the plate 4 is pivoted to the wall 3 with common links on the left-hand side of the drawing while it is only at the right-hand side that by means of the lever arm 2 and the same structure as in FIG. 1 it will be torn from the locked position into the opening position when a predetermined limit pressure is exceeded. The links 10 ensure that the plate 4 will not be flung away but will remain secured to the wall 3.

Figure 5:
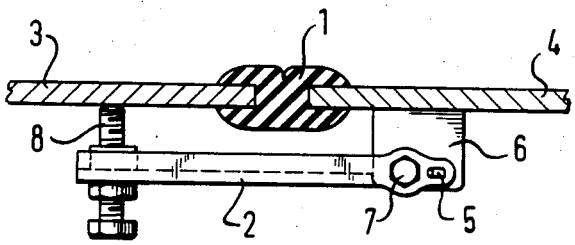
FIG. 5 is a cross-sectional view of the transitional portion from the wall via the clamping section to the plate, including a side view of a different structure of the lever arm.
Figure 6:
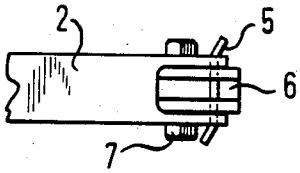
FIG. 6 is a partial plan view of the pivot of the embodiment of FIG. 5.

As shown in FIG. 5 the bearing block 6 is secured to the lower side of the plate 4 such that the retaining force through the lever arm 2 and the adjusting element 8 can be varied by urging the screw constituting the adjusting element 8 towards the inner side of the wall 3 and increasing the pressure by turning the screw further inwardly. When the preset limit pressure is exceeded the locking element 5 will break so that the lever arm 2 will be swung counterclockwise and the plate 4 may be torn from the rubber-elastic clamping section 1. In contrast to the embodiment shown in FIGS. 1 to 4 the locking element 5 of the embodiment shown in FIGS. 5 and 6 is disposed on the side of the pivot 7 of the lever arm 2 remote from the adjusting element 8. But in this case, too, the torque is determined by the distance A between the pivot 7 and the locking element 5. The ratio of this distance A to the distance B also determines the ratio between the force required for breaking the locking element 5 and the compressive force applied to the plate 4.

Naturally, further modifications and embodiments of the invention/innovation are possible within the scope of the principle described above. For instance, this principle may be applied to a variety of types of containers or tanks and closed spaces as well as various designs of cover plates, lids and the like.

Moreover, the distance between the point of contact of the adjusting element 8 on the plate 4 and the locking element 5 or, respectively, the pivot 7 may be made variable.

I claim:

1. An explosion cover plate for containers and ships' holds, especially an explosion hatch, which is pivoted by means of at least one lever arm to a wall of the container or ships' hold to be closed and by means of a locking element is retained in a closure position in which it closes off an opening in said wall wherein the locking element upon occurrence of a predetermined overpressure and/or negative pressure in said container or ships' hold will shear or break from the wall to at least partially release the opening, characterized in that the lever arm (2) bridges a flexionally elastic clamping section (1) which sealingly maintains the cover plate in the closure position and will release the same only at the predetermined overpressure or negative pressure, and in that a bearing block (6) is mounted either on the wall (3) or the plate (4) in the vicinity of the clamping section (1), said bearing block being provided both with the pivot in the form of a pivot bearing (7) and with the support for the locking element (5), and, further, in that the lever arm (2) at the end remote from the bearing block (6) is adjustably supported by means of a setting element (8) either on the plate (4) or the wall (3).

2. An explosion cover plate is claimed in claim 1, characterized in that the locking element (5) is a shearing pin.

3. An explosion cover plate as claimed in claim 1, characterized in that the bearing block (6) is a U-member and is externally welded to the wall.

4. An explosion cover plate as claimed in claim 1, characterized in that the lever arm (2) is constituted by a U-member.

5. An explosion cover plate as claimed in claim 1, characterized in that the setting element (8) is a screw.

6. An explosion cover plate as claimed in claim 1 or claim 7, characterized in that the distance A in longitudinal direction of the lever arm (2) from the pivot to the locking element (5) is substantially less than the distance B from the pivot to the setting element (8).

7. An explosion cover plate as claimed in claim 6, characterized in that the ratio of the distances B:A is about 4:1 to 5:1.

8. An explosion cover plate as claimed in claim 6 or claim 9, characterized in that said opening is provided with a rim and that the distance G from the pivot to the rim (9) of the wall (3) covered by the clamping section (1) is about twice the distance A.

* * * * *